United States Patent [19]

Lambert

[11] Patent Number: 4,694,608

[45] Date of Patent: Sep. 22, 1987

[54] SECURITY BAR SYSTEM FOR LOUVERED WINDOW UNITS

[76] Inventor: Earl B. Lambert, 9-1 Peppertree Ter., Christiansted, St. Croix, V.I. 00820

[21] Appl. No.: 501,636

[22] Filed: Jun. 2, 1983

[51] Int. Cl.[4] ..... E06B 3/68

[52] U.S. Cl. ..... 49/50; 49/51; 49/64

[58] Field of Search ..... 49/51, 64, 50; 52/106, 52/727

[56] References Cited

U.S. PATENT DOCUMENTS

| | | | |
|---|---|---|---|
| 679,028 | 7/1901 | Larmore | 49/50 X |
| 2,125,807 | 8/1938 | Petty | 52/727 |
| 2,761,371 | 9/1956 | Parrish | 49/51 |
| 3,460,289 | 8/1969 | Toth | 49/50 |
| 4,077,167 | 3/1978 | Rieder | 49/50 X |
| 4,395,861 | 8/1983 | Fipke et al. | 49/50 X |

*Primary Examiner*—Philip C. Kannan
*Attorney, Agent, or Firm*—John B. Dickman, III

[57] ABSTRACT

An improved security bar system for louvered windows is disclosed. The window unit has louvered blades which pivot on horizontal stub shafts.The security bars are mounted on the stub shafts where the louver blades hide them from view and provide an esthetically pleasing window unit. Each security bar has a hardened steel rod with holes bored in each end for receiving the stub shafts and a hardened steel sleeve which freely rotates on the steel rod and covers the rod and stub shafts. The steel rod freely rotates on the stub shafts which are themselves freely rotatable. Therefore, any attempts to cut the security bar will cause the steel sleeve to rotate. Should the steel sleeve be held stationary and cut, the covered steel rod will rotate due to the action of the saw blade.

14 Claims, 9 Drawing Figures

SECURITY BAR SYSTEM FOR LOUVERED WINDOW UNITS

BACKGROUND OF THE INVENTION

The present invention relates to a security bar system for louvered window units, and, in particular, to an improved security bar system for louvered window units which is hidden from view and has freely rotatable parts which resist cutting.

Heretofore, security bars and security bar systems have been exposed in front of the protected window or door unit. Commonly used security bars have fixed steel rods mounted on the window unit or to the wall surface adjacent the window opening. Such security bars serve a purpose in that they deter most people who might otherwise consider breaking in. They do not, however, prevent the serious criminal who would cut through the bars with a hacksaw or other device. It is obvious that stationary bars can be cut since they offer little resistance.

Another type of security bar is a rotatable bar similar to the bar described in U.S. Pat. No. 4,077,167. This bar is pivotally housed on pivot pins for rotation, therefore any cutting motion by a saw blade will cause it to rotate. However, it is a simple matter to grip the bar with vise grip pliers or similar type tools to render it stationary while it is being cut.

Still another approach is to hide the security bars in the louver blades as shown in U.S. Pat. No. 3,460,289. The security bars are used as pivot rods for the louver blades and are embedded in putty to hide them. However, once an intruder discovers that the bars are hidden by the louver blades, a hack saw can be used to cut them.

SUMMARY OF THE INVENTION

The present security bar system consists of rotatable steel bars which rotate on the stub shafts of the louver blades and an outer steel sleeve that hides the steel bars and stub shafts. The security bar system can be incorporated in the louver assembly thereby making it further invisible to inspection by a possible intruder. By making all of the parts freely rotatable, any attempt to cut through a bar will cause one or more parts to rotate, thereby resistiing any cutting action.

OBJECTS OF THE INVENTION

It is an object of this invention to provide a secure, aesthetically acceptable window unit for residential and commercial use.

Another object is to provide a security system which is manufactured as part of a window unit and is easy to install.

A further object is to provide a security system used with metal or glass louver blades.

A still further object is to provide a security system that incorporates simplicity of design with minimum working parts that will replace the more costly security grills or bars.

BRIEF DESCRIPTION OF THE INVENTION

Figure 1:
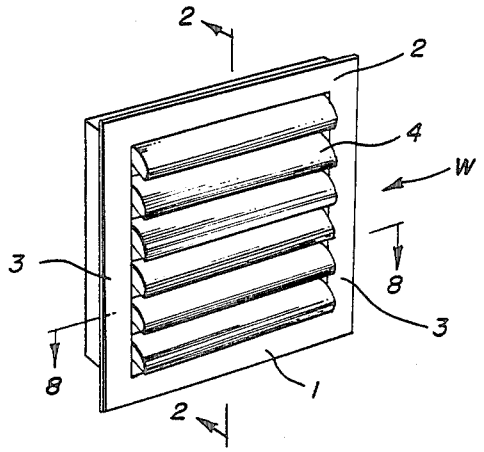
FIG. 1 is a perspective view of a burglar resistant louver window unit of the present invention.

Referring to FIGS. 1 through 8 there is disclosed a security bar system for louvered window units. FIG. 1 shows a typical louvered window unit W, which would incorporate the security bar system of this invention. The window unit W has a window frame which includes a sill 1, a head 2 and a pair of jambs 3 where the sill 1 and head 2 are assembled to the jambs 3 at right angles. Attached to the jambs 3 for rotation are louver blades 4, operated by an operator bar and crank system, to be discussed later.

Figure 2:
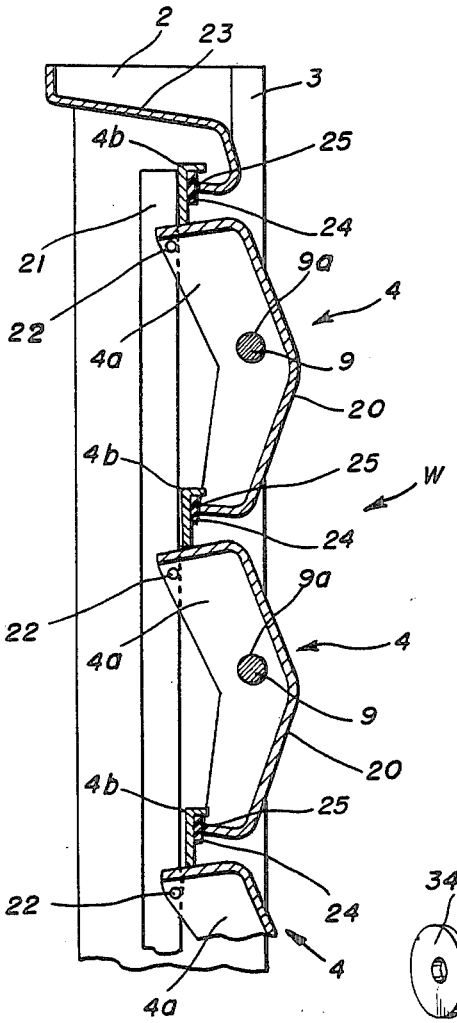
FIG. 2 is a plan view taken on the line 2—2 of FIG. 1.

FIG. 2 shows a detail of the louver blades 4 mounted in a jamb 3. Each louver blade 4 is formed sheet or aluminum metal with a closure face and a pair of integral wings 4*a* (one shown). Extending across the top edge of the closure face is an integral channel 4*b* of 20 with weather stripping 24 attached to the vertical wall. The lower edge 25 of the closure face 20 has a horizontal blade which presses against the weather stripping 24 of the next louver blade to provide an airtight seal when the louver blades are closed.

The attaching wings 4*a* are rotationally mounted to jambs 3 by a security bar system 9, where an aperture 9*a* allows free movement of the lower blade 4 on a shaft. By virtue of the rotation of the louver blades on the security bar system 9 and the operation of an operated bar 21 which is attached to each louver blade 4 by pins 22, the louver blades are capable of being opened and closed by a crank system, briefly shown in FIGS. 3 and 8.

The head 2 of the window unit W has a shield 23 which seals the uppermost louver blade 4 against air leakage.

Figure 4:
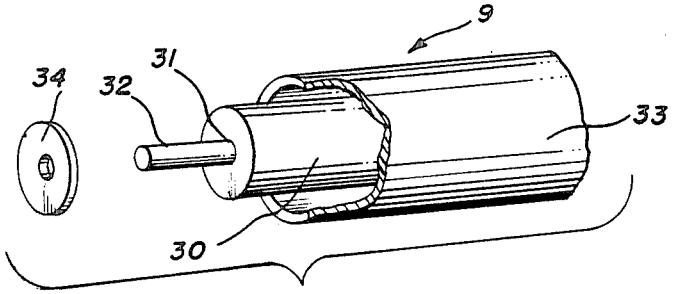
FIG. 4 is a perspective view of a security bar of the present invention.

FIG. 4 shows the details of one of the security bar systems 9. Each security bar system has a steel rod 30 with a bore 31 on each end. The bore 31 is sized to receive a stub shaft 32. Covering the steel rod 30 and the stub shafts 32 is a steel sleeve 33. As stated, the louver blades 4 are rotationally mounted on the security bar system 9. The size of the aperture 9*a* in the wing 4*a* is large enough for the stub shafts 32 to pass through, but not the steel bar 30, therefore the window unit W is assembled by positioning the steel bar 30 with the steel sleeve covering it between the wings 4*a* of the louver blade 4 and inserting the stub shafts through an aperture in the jamb and through aperture 9*a* in the wing 4*a*. By this arrangement the security bar system is hidden from plain view and all of its parts are freely rotatable.

Figure 8:
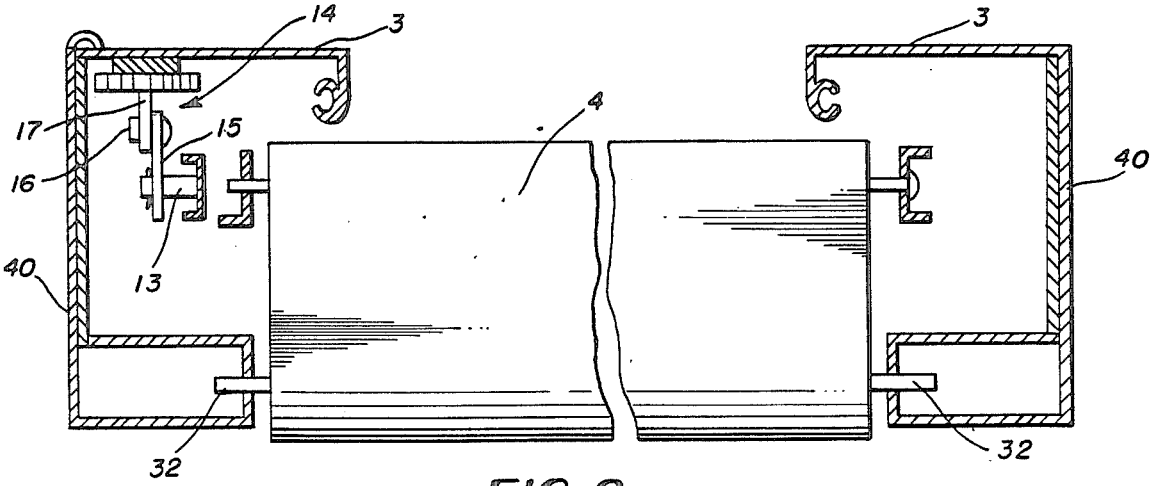
FIG. 8 is a top sectional view taken on the line 8—8 of FIG. 1.

FIG. 8 shows jamb 3 with a separate adapter cover 40 which conceals the stub shaft 32. Since the window unit is mounted in a window opening the unit can not be taken apart without removing the entire unit from the opening, which adds to the security of the unit as a whole.

To provide frictionless rotation of the louver blades 4, the stub shafts 32 and steel bars 30, a nylon bushing 34 is inserted between the end of the steel bar 30 and the wing 4a.

Figure 6:
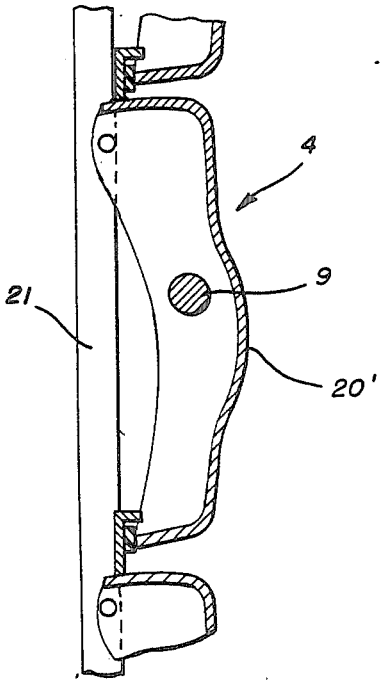
FIG. 6 is a sectional view of another embodiment of the louver blades of this invention taken on the line 2—2 of FIG. 1.
Figure 7:
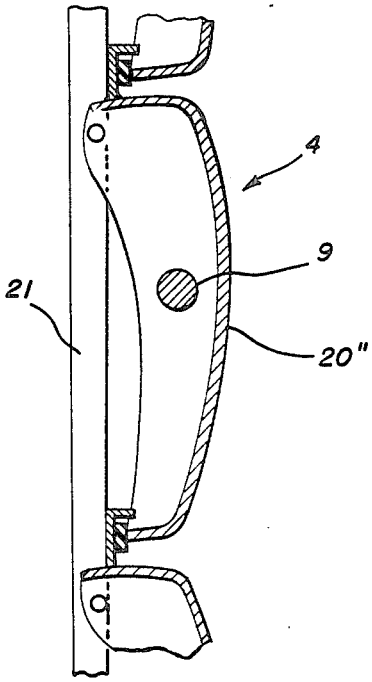
FIG. 7 is a sectional view of still another embodiment of the louver blades of this invention taken on the line 2—2 of FIG. 1.

FIGS. 6 and 7 show two other embodiments of the louver blades 4. In FIG. 6 the shape of the closure face 20 has a decorative hump.

Figure 5:
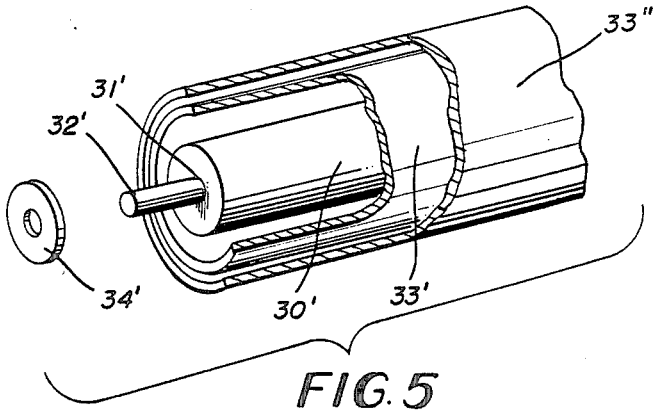
FIG. 5 is a perspective view of another embodiment of a security bar of the invention.

Another embodiment of the security bar system is shown in FIG. 5, where the steel bar 30' has a bore 31' to receive a stub shaft 32' and a first sleeve 33' covers the steel bar 30' and the stub shafts 32'. A second sleeve 33'' is provided for added security. Nylon bushing 34' is also provided.

In FIG. 7 the shape of the closure face 20'' has a smooth convex surface for decorative purposes.

It should be realized in each of the embodiments of FIGS. 2, 6 and 7 that the security bar system 9 is hidden from plain view by the shape of the louver blade and the manner in which the security bar system is utilized as pivot points for the corresponding louver blade. Therefore, esthetically, the security bars do not interfere with the enjoyment of looking out of the window.

The window crank system 14 of FIG. 8 is not shown in detail, however, the crank system 14 is similar to well known crank systems in the window opening art. There is an operator handle 42 and a gear arm 17 attached to an operator link by a rivet 16. The operator link 15 is then attached to the operator bar 21 as shown in FIGS. 2, 6 and 7, by a rivet 13 and locked in place by an E-ring (not shown). The clockwise rotation of crank handle 42 moves gear arm 17 downward which in turn engages link arm 16 and operator bar 21 downward, pulling louver blade 4 downward at its point of attachment to the operator bar 21. Louver blades 4 then pivot on stub shafts 32, activating the louver blades 4 to a variable pitch position of being opened according to the number of turns of the operator crank system 14. The gear system which is concealed in the operator crank system housing restrains the opened and closed window unit position at any given point.

Figure 3:
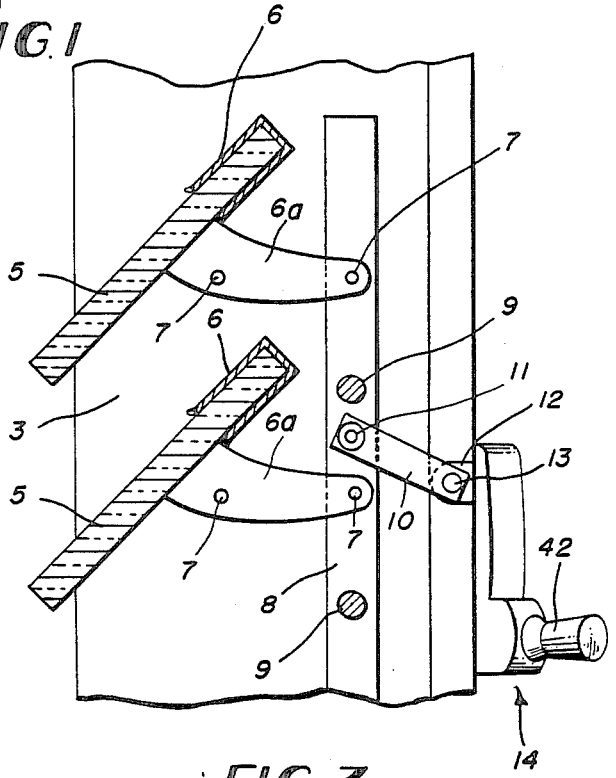
FIG. 3 is a sectional view of another embodiment of this invention taken on the line 2—2 of FIG. 1.

Instead of a metal louver blade, glass jalousie blades may be used in the window unit W. FIG. 3 shows glass jalousie blades bonded to clips 6 by silicone. The clips 6 are attached to the jalousie window blades at each end with the clips attached to window jambs 3 by pivot pins 7. Each clip 6 has an integral arm 6*a* which extends perpendicular to the jalousie blade 5. This arm 6*a* is pivotally connected to an operator bar 8 for opening and closing the jalousie blades. Movement of operator bar 8 is controlled by a link 10, pivotally connected to operator bar 8 and to an operator gear arm 12 by pivot pin 13.

An operator handle 42 is part of an operator mechanism 14, which is fastened to window jamb 3 by bolts. Operator gear arm 12 is moved vertically by rotation of handle 42, downward movement of the gear arm 17 causes the jalousie louver blades to close while upward movement causes them to open. The jalousie louver blades 5 being pivotable on pin 7 are capable of near ninety degree rotation to afford uninterrupted visibility, except for the line of each blade.

In order to provide maximum visibility, the security bar systems 9 are attached to the operator bar 8, at a place where movement of the jalousie louver blades 5 and the security bar systems 9 are in the same plane when the louver blades are fully opened and in line with the louver blades overlap when fully closed. When the jalousie louver blades 5 are partially open the security bar systems 9 are generally in the same plane as the top edge of the louver blades.

The security bar systems 9 are similar to the system shown in FIG. 4 with the possible exception that a special stub shaft 32'' may be used to prevent the security bar systems from coming apart. Special stub shaft 32'' has an integral washer 50 which is positioned between the operator bar 8 and the end of steel rod 30. With the washer 50 so positioned the stub shaft 32'' can not work its way out of the bore 31 in the steel bar.

Figure 4A:
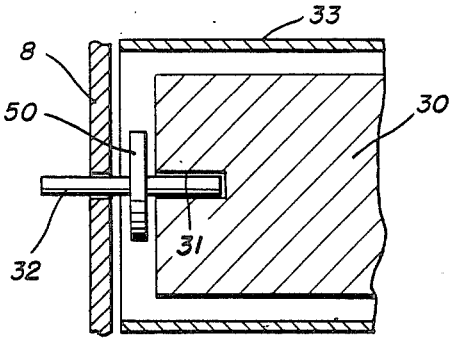
FIG. 4*a* is a partial sectional view of one end showing the pivot pin inserted in the rod 30.

The operation of the security bar systems 9 in FIGS. 4, 4*a* and 5 prevents an intruder from cutting through the bars. Since the outer sleeve 33 freely rotates on steel bar 30, which in turn freely rotates on stub shafts 32, which themselves are freely rotatable, it is clear that the teeth of a saw blade will merely cause first the sleeve 33 to rotate, and should the sleeve be held stationary and cut through, the steel bar 30 will rotate. Because the sleeve 33 completely covers the steel bar 30, the bar can not be held stationary, therefore it will rotate. Should an intruder attempt to cut the stub shafts 32, they also freely rotate, and in addition they are concealed which makes it almost impossible to hold them stationary in order to cut through.

The metal window units are made of aluminum, while the glass jalousies are made of thick glass of about one quarter inch thickness. The security bar system is made of a hardened steel which resists cutting, this includes the stub shafts, steel bars and sleeves. Other materials may be used in place of the preferred materials where they are as good or better for the purpose of securing a louvered window unit.

Removal of the security bars is prevented by the concealment of the stainless or hardened steel pins on each end of said bar by means of jamb adapter sections 40, attached to the outside of the jambs and covering the projected pins, thus obscuring them from view. The outside of the jamb adapters is then fastened to the wall of the building, rendering the security bars inaccessible to anyone attempting unlawful entry. A vertical mullion adapter section conceals the pins of multiple window units similar to the jamb adapter.

It should be understood that while various embodiments of the invention have now been disclosed, one skilled in the art may upon studying the drawings and specification may contemplate other embodiments. Therefore, one should consider the invention in view of the drawings, specification and the following claims.

I claim:

1. A security bar system for windows and window openings in which each has a defined open or openable area surrounded by a solid structure comprising:

a. at least one cylindrical cut resistant bar member having a sufficient length to extend across the open area;

b. apertures in each end of said bar member;

c. a pair of stub shafts rotatably mounted in said apertures where said bar member and stub shafts freely rotate;

d. a pair of mounting apertures in the solid structure surrounding the open area for receiving one end of the stub shaft; and e. a cylindrical, cut resistant sleeve rotatably mounted on said bar member and covering the bar and the exposed area of said stub shafts.

2. A security bar system as in claim 1 wherein said pair of mounting apertures are in the vertical members of a window.

3. A security bar system as in claim 2 wherein the window is a louvered window and the stub shafts are pivot pins for the louvered blades.

4. A security bar system as in claim 3 in which said pivot pins have bushings of suitable material.

5. A security bar system as in claim 1 wherein the window is a louvered jalousie window and the stub shafts are in the operator bars for opening and closing the louver blades.

6. A security bar system as in claims 3 or 5 wherein at least one bar member is located in the window to be hidden from plain view.

7. A security bar system as in claim 6 wherein said stub shafts, bar member and sleeve are hardened steel.

8. A security bar system as in claim 7, whereby said stub shafts, bar member and sleeve are stainless steel.

9. A security bar system comprising:

a. a cylindrical hardened steel bar member having apertures in each end:

b. a pair of stub shafts rotatably mounted in said bar member and extending therefrom to be supported in a window unit or window opening; and c. a hardened steel cylindrical sleeve covering said bar member and a portion of said stub shafts extending from said bar member, wherein said stub shafts fit in apertures on opposite sides of a window unit or window opening to prevent entry by intruders.

10. A security bar system as in claims 5 or 9 wherein a plurality of said security bar systems are spaced in the window opening or window at a distance to prevent entry, and where each security bar system has freely rotatable sleeves, bar members and stub shafts to prevent cutting by a saw blade.

11. A security bar system as in claim 9 in which said cylindrical hardened steel bar member is constructed for easy initial installation and repair in a specific window.

12. A security bar system as in claim 9 in which said stub shafts are movably mounted by means positioned in said apertures of said steel bar member.

13. A burglar resistant window unit comprising a frame, said frame having a head, sill and a pair of jambs, additional jamb adapters mounted on said jambs to strengthen said unit, said frame contains;

a. at least one cylindrical cut resistant bar member having a sufficient length to extend across the open area of said frame, b. apertures in each end of said bar member, c. a pair of stub shafts rotatably mounted in said apertures where said bar member freely rotates on said stub shafts, d. a pair of mounting apertures in the solid jamb structure surrounding the window receiving the ends of the stub shaft, and;

e. a cylindrical cut resistant sleeve rotatably mounted on said bar member covering said bar member and the exposed area of said stub shafts.

14. A unit as set forth in claim 13 in which said jamb adapters protect and conceal said apertures and said stub shafts.

* * * * *